United States Patent [19]

Hubbard et al.

[11] Patent Number: 4,941,470

[45] Date of Patent: Jul. 17, 1990

[54] FACE MASK WITH EAR LOOPS AND METHOD FOR FORMING

[75] Inventors: Vance M. Hubbard; Welton K. Brunson, both of Bedford, Tex.

[73] Assignee: Tecnol, Inc., Fort Worth, Tex.

[21] Appl. No.: 142,743

[22] Filed: Jan. 11, 1988

Related U.S. Application Data

[63] Continuation-in-part of Ser. No. 815,753, Dec. 31, 1985, Pat. No. 4,802,473, which is a continuation of Ser. No. 549,392, Nov. 7, 1983, abandoned.

[51] Int. Cl.[5] ..... A62B 7/10

[52] U.S. Cl. ..... 128/206.13; 128/206.19

[58] Field of Search ..... 128/206.11, 206.12, 128/206.13, 206.15, 206.16, 207.13, 139, 201.17, 201.18, 230, 231; 2/DIG. 9, 184, 330, 243 K, 243 A; 24/3 B, 3 C, 3 M, 114.5; 139/386, 387 R, 421, 423

[56] References Cited

U.S. PATENT DOCUMENTS

| | | | |
|---|---|---|---|
| 1,292,095 | 1/1919 | Schwartz . | |
| 2,891,541 | 6/1959 | Tietze | 128/141 |
| 2,916,037 | 12/1959 | Hansen . | |
| 3,049,121 | 8/1962 | Brumfield et al. | 128/146 |
| 3,603,315 | 9/1971 | Becker, III | 128/146 |
| 3,613,678 | 10/1971 | Mayhew | 128/146 |
| 3,664,335 | 5/1972 | Boucher et al. | 128/146 |
| 3,802,429 | 4/1974 | Bird . | |
| 3,834,384 | 9/1974 | Raines | 128/146 |
| 3,837,995 | 9/1974 | Floden | 161/150 |
| 3,855,048 | 12/1974 | Bagnall | 161/159 |
| 3,888,246 | 6/1975 | Lauer | 128/146 |
| 3,890,966 | 6/1975 | Aspelin et al. | 128/146 |
| 3,971,369 | 7/1976 | Aspelin et al. | 128/146 |
| 3,974,829 | 8/1976 | Tate, Jr. | 128/146 |
| 4,037,593 | 7/1977 | Tate, Jr. | 128/146 |
| 4,300,549 | 11/1981 | Parker | 128/206 |
| 4,417,575 | 11/1983 | Hilton et al. | 128/206 |
| 4,419,993 | 12/1983 | Peterson | 128/201 |
| 4,522,203 | 6/1985 | Mays | 128/132 |
| 4,606,341 | 8/1986 | Hubbard et al. | 128/206 |
| 4,635,628 | 1/1987 | Hubbard et al. | 128/201 |
| 4,657,802 | 4/1987 | Morman | 604/365 |
| 4,662,005 | 5/1987 | Grier-Idris | 2/9 |

FOREIGN PATENT DOCUMENTS

| | | |
|---|---|---|
| 867791 | 11/1941 | France . |
| WO81/01019 | 4/1980 | PCT Int'l Appl. . |
| WO81/03266 | 11/1981 | PCT Int'l Appl. . |
| 2717968 | 12/1977 | United Kingdom . |
| 2103491 | 2/1983 | United Kingdom . |

*Primary Examiner*—Randall L. Green
*Assistant Examiner*—K. M. Reichle
*Attorney, Agent, or Firm*—Baker, Mills & Glast

[57] ABSTRACT

A face mask (10) includes a layer (12) of meltblown polypropylene fabric having pleats (18–22) formed therein. An ear loop (14) and an ear loop (16) formed from lycra spandex are attached to the corners of the layer (12). Application of heat along seams (24) and (26) attach the ear loops (14) and (16) thereto in addition to securing the ends of the pleats (18–22). In this manner, internal fibers of the layer (12) are restrained from entering the surrounding environment.

1 Claim, 1 Drawing Sheet

FACE MASK WITH EAR LOOPS AND METHOD FOR FORMING

RELATED APPLICATIONS

This application is a continuation-in-part of application Ser. No. 815,753 filed Dec. 31, 1985, now U.S. Pat. No. 4,802,473, which in turn is a continuation of application Ser. No. 549,392 filed Nov. 7, 1983, now abandoned.

TECHNICAL FIELD OF THE INVENTION

The present invention pertains in general to face masks and, more particularly, to a method and apparatus for forming the face masks to prevent fibers from the face mask material from contaminating the environment in which the face masks are used.

BACKGROUND OF THE INVENTION

Face masks that are designed to be worn in sanitary environments such as hospitals or the like require the use of a fibrous material for filtering any contaminants from the wearer. Present face masks generally use a sewing operation in the fabrication thereof which requires a needle to pierce the fibrous material in order to form the seams. This procedure results in perforations in the material such that the fibers contained therein can escape and potentially contaminate the environment. Also, the perforations provide passages for contaminants to pass through. With such masks, the fibers released by the sewing operation may be breathed by the mask wearer, as the wearer is continually inhaling and exhaling through the mask. This is an undesirable condition in that it is of primary importance that all sources of contamination be minimized. Therefore, there exists a need for a sanitary face mask that does not have the disadvantages of the sewn face masks described above.

Previously developed face masks have also generally been secured to the head of a wearer by elongated ties which must be tied together by the wearer. Such ties are often difficult to attach together and sometimes tend to become unfastened. A need has thus arisen for a sanitary mask with looped earpieces which provide a comfortable fit while being easy to attach over the ears of the wearer.

SUMMARY OF THE INVENTION

The present invention disclosed herein comprises a method and apparatus for forming a sanitary face mask that maintains the integrity of the mask material by preventing the fibers thereof from escaping the confines of the material. The apparatus includes a layer of fabric dimensioned to cover the nostrils and mouth of the wearer, the fabric fabricated from a heat malleable material. First and second ear loops are fabricated from an elongated layer of heat malleable material. Each end of the first and second ear loops are attached to the layer of fabric on one side thereof with a heat formed seal. The heat formed seal prevents the fibers of the fibrous layer from being disturbed.

According to another aspect of the present invention, a reinforcing member is disposed adjacent the upper edge of the face mask and a portion of the edge is folded over the rigid member and heat sealed around the perimeter of the semi-rigid member. The semi-rigid member provides support for the upper portion of the face mask about the face of the wearer. Pleats are formed in the fabric layer to allow expansion thereof. The edges of the pleats are heat sealed such that only the center portion of the fabric in the pleats can expand to conform to the face of the wearer.

According to yet another aspect of the present invention, a method is provided that includes the step of fabricating a layer of fibrous heat malleable material that is dimensioned to fit over the mouth and nostrils of the wearer. First and second ear loops are then fabricated from a layer of elastically deformable heat malleable material. Each of the first and second ear loops is attached to opposite sides of the fibrous layer by applying heat to the juncture of the ear loop material and the fibrous layer material such that an attachment is formed therebetween without disturbing the fibers in the fibrous layer.

According to another aspect of the present invention, pleats are formed in the layer of fibrous material and the sides thereof heat sealed to allow only the center portion of the fibrous layer to expand. The edges of the fibrous layer are folded over and heat sealed to form seams therearound.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
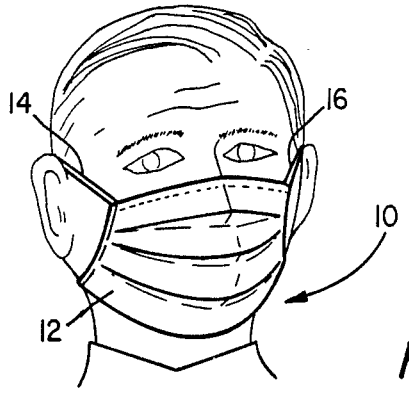
FIG. 1 illustrates a perspective view of the face mask disposed on a wearer.

Referring to FIG. 1, there is illustrated a perspective view of a face mask 10 disposed on a wearer. The face mask 10 is comprised of a rectangular shaped layer 12 of pleated material, an ear loop 14 attached to one side and an ear loop 16 attached to the other side. The ear loops are designed to fit over the ears of the wearer and the pleated material allows for expansion in the middle of the layer 12 only. In this manner, the lower end of the layer 12 can expand down over the chin of the wearer and the upper end can extend up over the bridge of the nose of the wearer. The face mask 10 therefore provides some conformation to the face of the wearer to prevent contaminants from entering the environment due to the inhaling and exhaling of the wearer.

Figure 2:
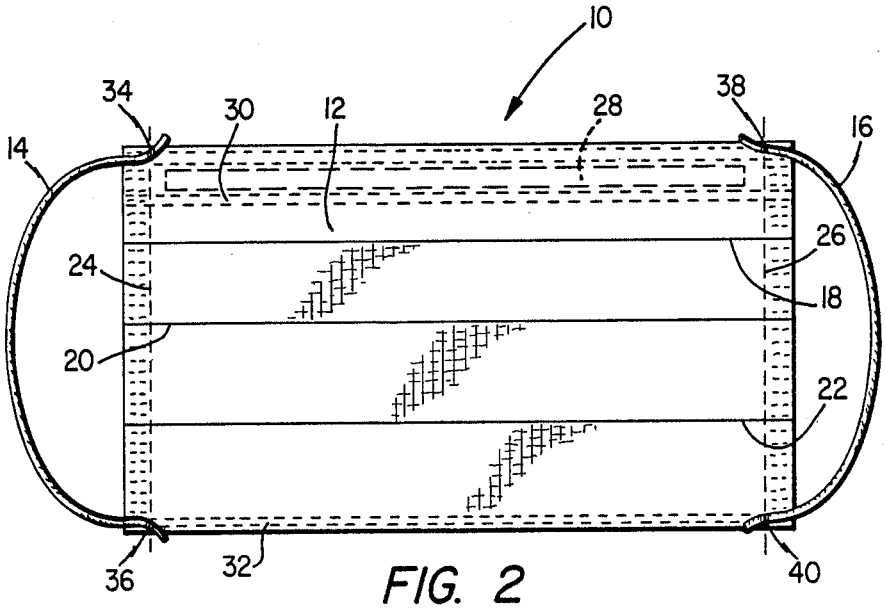
FIG. 2 illustrates a planar view of a face mask of the present invention.

Referring now to FIG. 2, there is illustrated a plan view of the face mask 10. The layer 12 is formed of a synthetic, thermoplastic polymeric micro-fiber material. Such a material is disclosed in J. Floden U.S. Pat. No. 3,837,995. The synthetic micro-fiber allows for hot melting techniques to provide adequate bonding thereof. These fabrics are referred to as meltblown polypropylene fabrics that can be obtained from Kimberly-Clark Corp. of the type-1/oz/sq. yd. Code No. 1270-00-00-00.

The layer 12 is formed from a larger layer that is folded a plurality of times to form pleats 18, 20 and 32 that are oriented horizontally with respect to the face of the wearer. A seam 24 and a seam 26 are formed along the lateral sides of layer 12 to prevent the pleats 18–22 from separating at the edges. The seams 24 and 26 are formed by heat bonding techniques, that is, applying heat and pressure to form a seal between pleats 18–22. In so doing, only the center portion of the pleats 18–22 in the layer 12 are allowed to expand to conform to the face of the wearer.

Given our invention, persons skilled in the art would realize that a high-frequency method of heat bonding takes much less time than a convection heat bonding process, and therefore such persons would appreciate the advantages in terms of expense and increased production rates attendant on a high-frequency heat bonding process.

A semi-rigid member 28 is disposed adjacent the upper horizontal edge of the layer 12. A portion of the layer 12 on the edge thereof is folded over the semi-rigid member 28 and attached to the surface thereof with a heat bonded seam 30. The seams 24 and 26 are formed after the seam 30 such that they form a lateral seam, thus enclosing the semi-rigid member 28 within the sterile confines of the layer 12. A seam is formed on the diametrically opposite edge of the layer 12 by folding a portion thereof over and heat bonding a seam 32 therein. The seam 32 is primarily used to define the edge of the layer 12.

The ear loop 14 is attached by heat bonding to one corner of the layer 12 at a point 34 and to an opposite corner on the same edge thereof to a point 36. The ear loop 16 is attached on a diametrically opposite side of the layer 12 from the ear loop 14 with one end thereof attached to a point 38 on one corner of layer 12 and to a point 40 on the opposite corner.

Figure 3:
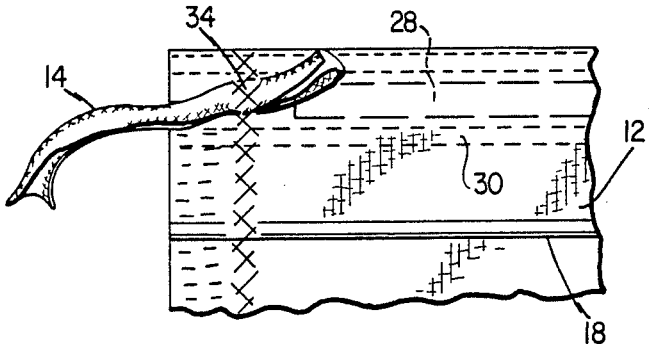
FIG. 3 illustrates an expanded view of the attachment point of the ear loop to the corner of the face mask.

Referring now to FIG. 3, there is illustrated an expanded view of the attachment point 34 of the ear loop 14. The ear loop 14 is fabricated from a combination of texturized polyester and lycra spandex. In the preferred embodiment the material is formed from 90.33 percent of 78 Denier texturized polyester and 9.67 percent of 40 Denier Lycra spandex. This material is cut into a thin strip and, due to the properties of the material, this strip will "roll over", that is, the edges thereof will curl up. In this manner, an elastically deformable strip is formed that has a semicircular cross section to provide some comfort behind the ears of the wearer.

Due to the properties of the ear loops 14, heat bonding techniques such as rf heat bonding can be used. Given our invention, persons skilled in the art would realize that the use of a synthetic fabric, such as the lycra spandex/polyester fabric of the invention, allows the use of a high-frequency heat bonding technique to attach the fabric to another synthetic fabric, and further would understand that heat bonding cannot be used with conventional rubber or thread-coated rubber loops because their structural integrity would be destroyed. Further, persons skilled in the art would realize, given our invention, that ear loops made out of a lycra spandex/polyester fabric have more "give" than conventional rubber or thread-coated rubber ear loops, and as such are much more comfortable to the sensitive skin behind the ear of the wearer.

To attach the loop 14 at the points 34 and 36, it is only necessary to apply suitable amounts of heat and pressure thereto. With such techniques, perforation of the mask material with a needle is not required. In the preferred embodiment, the seams 24 and 26 are formed by placing the free ends of the ear loops 14 and 16 thereon and forming the pleats 18–22 at the same time that the loops 14 and 16 are bonded thereto.

In summary, there has been provided a sterile face mask that reduces the amount of internal fibers thereof that escape into the surrounding environment or which are breathed by the wearer. The face mask includes a layer 12 formed of Meltblown Polypropylene fabric with ear loops 14 and 16 heat bonded thereto. The use of heat bonding techniques allows the attachment of the ear loops thereto without puncturing the surface of the material. This prevents internal fibers of material from escaping to the surrounding environment.

Although the preferred embodiment has been described in detail, it should be understood that various changes, substitutions, and alterations can be made therein without departing from the spirit and scope of the invention as defined by the appended claims.

What is claimed is:

1. A method for fabricating a sanitary face mask, comprising;

fabricating a layer of meltblown polypropylene fabric having a horizontal and vertical axis;

forming at least one pleat in the meltblown layer along the horizontal axis thereof such that the pleated meltblown layer is dimensioned to fit over the mouth and nostrils of a wearer;

heat sealing the sides of the pleated meltblown layer along the vertical axis thereof to allow the pleats to expand in the center portion only;

disposing a semi-rigid member along one edge of the pleated meltblown layer parallel to the horizontal axis thereof and folding a portion of the edge over the semi-rigid member, the folded-over portion being heat sealed about the perimeter of the semi-rigid member to completely enclose the semi-rigid member;

forming first and second ear loops from narrow strips of a combination of textured polyester and lycra spandex, said combination comprising 90.33 percent textured polyester and 9.67 percent lycra spandex so that the edges of each of said ear loops curl over to form a rounded cross section therefor; and attaching the free ends of each of the ear loops on opposite ends of one of the lateral sides of the pleated beltblown material on a vertical edge thereof by heat bonding.

* * * * *